United States Patent [19]

Hoffart

[11] Patent Number: 4,539,886

[45] Date of Patent: Sep. 10, 1985

[54] GUITAR

[76] Inventor: Dean Hoffart, #429-93 Parliament St., Toronto, Ontario, Canada, M5A 3Y7

[21] Appl. No.: 626,246

[22] Filed: Jun. 29, 1984

[51] Int. Cl.[3] ..... G10D 1/08

[52] U.S. Cl. ..... 84/267; 84/291; 84/1.16

[58] Field of Search ..... 84/267, 291, 1.16, DIG. 24

[56] References Cited

U.S. PATENT DOCUMENTS

| | | | |
|---|---|---|---|
| 906,612 | 12/1908 | Cayton | 84/291 |
| 2,977,835 | 4/1961 | Hornseth | 84/291 |
| 4,147,084 | 4/1979 | Underwood | 84/1.16 |
| 4,290,336 | 9/1981 | Peavey | 84/291 |
| 4,311,078 | 1/1982 | Falgares | 84/267 |

*Primary Examiner*—Forester W. Isen

*Attorney, Agent, or Firm*—Sim & McBurney

[57] ABSTRACT

A guitar has a body and a neck extending from the body. The body has a central core and two panels sandwiching the core means between them. The side edges of the panels are curved toward each other and secured, so that both panels are rounded convex outwardly. At one end of the lenticular cavity thus defined the body is closed by suitable panel means. The other end is left open, and preferably has two upwardly and outwardly sloping openings.

9 Claims, 3 Drawing Figures

GUITAR

This invention relates generally to guitars, and has to do particularly with a novel guitar construction which permits a lowering of expense for manufacture, while at the same time providing an instrument of enhanced and improved tonal quality.

BACKGROUND OF THIS INVENTION

The guitar is one of a number of stringed instruments of similar though not identical construction. The object in the construction of all of these instruments is to provide a resonating hollow body, capable of taking up and enhancing the vibrational qualities imparted by a plucked, bowed or struck string.

The body of a conventional guitar normally consists of an hourglass-shaped side wall separating a top panel from a bottom panel. Bracing structure is provided inside the cavity thus defined, for purposes of rigidity and for purposes of enhancing the sound characteristics.

GENERAL DESCRIPTION OF THIS INVENTION

I have now discovered that a superior guitar can be constructed by employing a quite different principle from that conventionally utilized in the construction of guitars. More particularly, I have discovered that a guitar body can be composed of a core, for example one or two elongated members, together with top and bottom panels of a material like plywood sandwiching the core between them. The panels are curved toward each other at their lateral or side edges so that these can be juxtaposed and secured to each other or to a fillet placed between them. This results in a top panel which is stressed so that it is rounded convex upwardly, whereas the bottom panel is likewise stressed so that it is rounded convex downwardly. My guitar construction incorporates a neck extending from the body portion, a lower bridge pressing against the top panel, and conventional strings stretching between the lower bridge and a position on the neck.

While plywood is highly suitable for the construction of this novel guitar body, chosen over the traditional solid wood veneer because of its inherently greater tensile strength (i.e. it can flex under pressure without cracking), it will be evident from what follows that any resiliently flexible material could be utilized in place of plywood. Materials such as stainless steel and brass, for example, could be employed. It is expected that such materials would be especially suited to bass and baritone scale instruments.

It is important to realize that the bodies of all other guitars are in tension only when their strings are tightened, whereas on the guitar which I have developed, the panels which provide the top and the bottom of the body are constantly in tension due to the way in which the body is constructed. The resulting tautness eliminates any necessity for additional structural braces. In effect, the top and bottom panels provide a kind of lenticular cylindrical structure which has extremely high strength due to the bowed nature of these panels.

I have discovered that this particular construction provides a unique sound, one which may be described as a bell-like sympathetic reverberation which is contingent upon but simultaneously independent from the sustain of the strings. This construction also displays exceptional sensitivity and response to a full spectrum of acoustical feedback when the strings are electronically amplified. I believe that this unique sound derives from the lenticular cross section of the body, the fact that both the top and the bottom are in tension at all times, and also the fact that the top and bottom surfaces make direct contact with one another at their lateral edges without the interval of a side between them. However, I do not wish to bound by this theory, and this patent application is not limited thereby.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
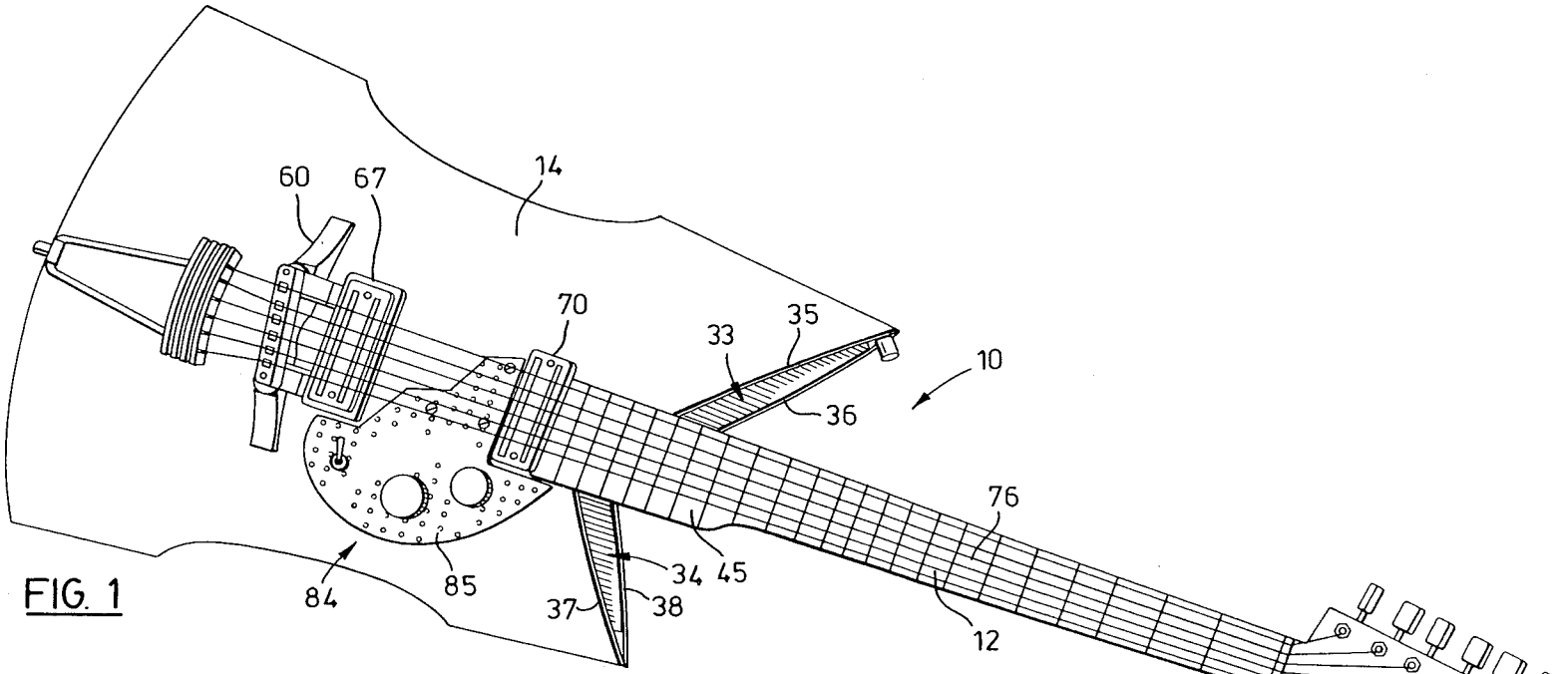
FIG. 1 is a perspective view of a guitar embodying my invention, taken generally from above.
Figure 2:
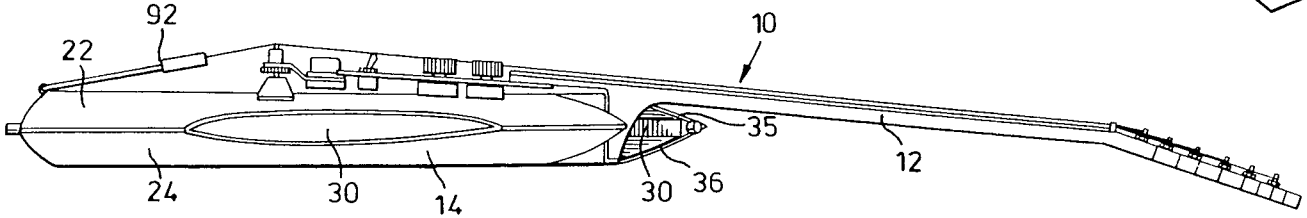
FIG. 2 is a further perspective view of the guitar of FIG. 1, taken generally from the side.

Attention is now directed to the drawings, which show a guitar generally at the numeral 10, the guitar including a neck 12 and a body portion 14.

The body portion 14 includes a core means which consists in this embodiment of two central brace members 16 and 18, each of which is provided with a series of perforations 20. The two central brace members 16 and 18 are spaced apart from one another, and parallel. The central brace members 16 and 18 are sandwiched between a top panel 22 and a bottom panel 24. The top panel 22 is stressed so as to be rounded convex upwardly, whereas the bottom panel 24 is stressed so as to be rounded convex downwardly. As particularly well seen in FIG. 3, the side edges of the panels 22 and 24 are juxtaposed against one another to provide lateral edges 26 and 28 for the body portion 14. Preferably, the top and bottom panels 22 and 24 are glued or otherwise firmly affixed to the top and bottom edges of the central brace members 16 and 18, and a similar form of gluing or other attachment secures the lateral edges of the top and bottom panels 22 and 24 against two fillets 30 which are wedge-shaped to accommodate the angle between the meeting lateral edges of these panels.

Figure 3:
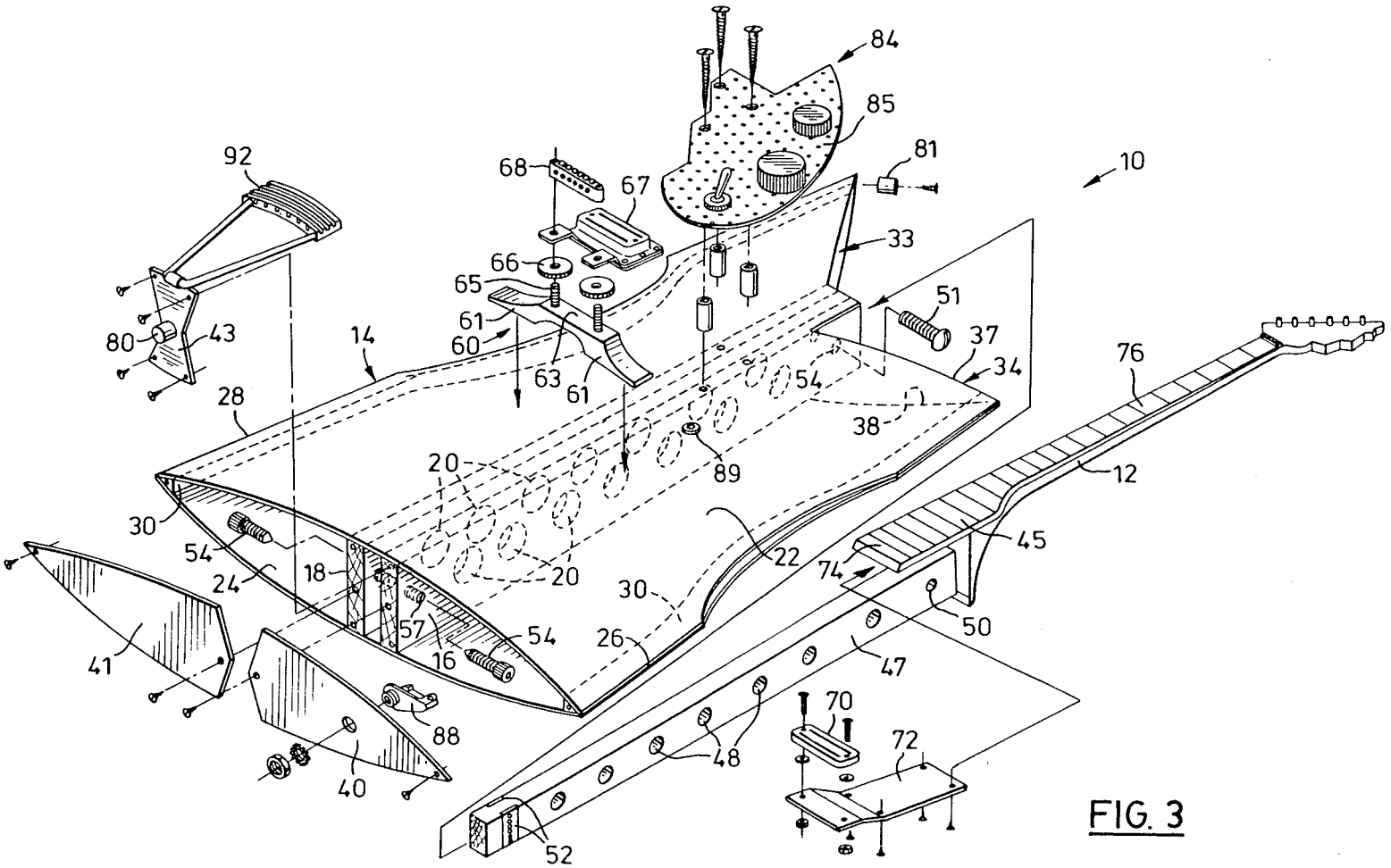
FIG. 3 is an exploded, perspective view of the guitar shown in the other figures.

As seen in FIG. 3, the lower or lefthand end of the body portion 14 is substantially a flat plane, due to the fact that the lower edges of each of the panels 22 and 24 are defined by straight lines (i.e. the edges would be straight if the tension in the panels were released for example by severing the joins at the lateral edges at fillets 30).

The other or upper end of the body portion 14, however, is configured to define two openings 33 and 34, each of these defining an acute angle with the neck 12. More specifically, the opening 33 is defined by two oblique edges 35 and 36 on the two panels 22 and 24, these edges sloping upwardly and outwardly with respect to the central brace members 16 and 18, thus defining a kind of wedge-shaped point or wing on the body portion 14. Likewise, two further oblique edges 37 and 38 are provided on the opposite side, also sloping upwardly and outwardly with respect to the neck 12, thus defining the opening 34. These openings 33 and 34 remain always open, and constitute the "sound holes" comparing to the opening or openings which are normally found on the top panel of a conventional guitar.

Note that the upper or bass half of the body is larger in area than the lower or treble half of the body. This design consideration is analogous to the varying proportions of pipes on a pipe-organ where larger, broader pipes necessarily support the longer wavelengths of the lower bass octaves while smaller, narrower pipes carry the shorter wavelengths of the treble octaves.

This assymetrical proportioning of the wing-like extensions of the body also functions such that a strap button, located on the end of fillet 30, above soundhole 33, is therefore placed also approximately in line with the 12th fret on the fingerboard 76 in order to provide a good playing balance for the instrument overall. The edges 35 and 36 intersect with the 18th fret on the fingerboard to allow for good playing access to the bass strings in these upper registers.

Also, the edges 37 and 38 of the lower wing, corresponding to soundhole 34, intersect with the 22nd fret on the fingerboard for maximum access to the treble strings in the upper registers.

Returning to the bottom end of the body portion 14, the lenticular opening is closed by two panels 40 and 41, which conform to the shape of the ends of the lenticular opening, together with an X-shaped panel 43. As can be seen, the plate 43 has four holes permitting the passage of threaded fasteners to be inserted into the leftward ends of the central brace members 16 and 18. Likewise, the plates 40 and 41 have holes at their inside and outside extremities to receive fasteners to allow them to be attached to the central brace members 16 and 18 and to the exposed ends of the fillets 30.

The neck 12 is a standard neck except for the provision of a widened fingerboard portion 45 adjacent the body 14 to allow the player the option of bending the strings in the upper fret positions downwardly away from the other strings, without pulling them off the side of the fingerboard 76.

The neck 12 is integral with or firmly attached with respect to a neck-rail 47 (see FIG. 3) which is adapted to be inserted into the gap provided between the central brace members 16 and 18. As can be seen, the neck-rail 47 has apertures 48 which are positioned so as to align with the apertures 20 in the central brace members 16 and 18. These apertures allow for an acoustical balance of air between the two sections of the interior. Furthermore, the neck-rail 47 has a borehole 50 to receive a bolt 51 passing through corresponding bores 54 in the central brace members 16 and 18, thereby to lock the position of the upper end of the neck-rail 47. The lower or leftward end of the neck-rail 47 (as seen in FIG. 3) has brass inserts 52 on which are provided a series of vertically aligned indentations. Into these indentations can be lodged the chisel-pointed ends of two bolts 54, adapted to be threaded into bores 57. This construction allows the neck angle to be adjusted by loosening the bolts 54 and retightening them in any of the alternative indentations on the brass inserts 52, with bolt 51 being the point of fulcrum. When the guitar is assembled and the strings tightened, the resulting tension in the neck-rail 47 enhances the acoustic timbre of the instrument overall.

As seen in all figures, a lower bridge foot 60 includes two pedestal portions 61 separated by a raised central portion 63. The lower bridge foot is held firmly against top panel 22 when the strings are tightened. The pedestal portions 61 bear against the top panel at locations which lie outwardly of the core means defined by the central brace members 16 and 18. In cross section, therefore, the construction is somewhat like the flying-buttress construction of a gothic or medieval church, with the panels 22 and 24 constituting the main arch, and the lower bridge foot acting in the manner of a flying buttress. Extending upwardly from the raised central portion 63 are two threaded shafts 65 on which are threaded adjustment thumbscrews 66. Above these thumbscrews 66 are secured the tabs supporting a treble pickup 67, and above these tabs is the lower bridge 68, held down in place by the tightness of the strings.

A bass pickup 70 is bolted to a plate 72 which is screwed to the underside of the fingerboard overhang 74 by standard fastening members which need not be described in detail, but which are shown in FIG. 3.

The overhang 74 is the end of the main fingerboard 76 which may typically be set with 22 frets corresponding to a 25½ inch string scale. The widening at 45 (see FIGS. 1 and 3) may be by about ½ inch, beginning at the 14th fret and reaching full extension at the 16th fret.

It is to be pointed out that the bass pickup 70 remains at a constant distance from the strings, regardless of the neck angle, and the attachment also allows the pickup of a direct acoustical amplification of the microphonic timbre of the neck, in conjunction with its amplification of the strings.

It will also be evident that the attachment of the treble pickup 67 is such as also to provide a constant distance to be maintained between the strings and the pickup. This also gives the pickup a direct acoustical contact with the microphonic timbre of the bridge construction in conjunction with its amplification of the strings.

The plate 43 holds a strap button 80, and another strap button 81 is screwed to the upper end of the further fillet 30.

A pickguard assembly shown generally at 84 is also provided. This consists of a perforated, copper-backed, bakelite plate 85 onto which a master volume, a master tone, a pickup selector switch, and a connection jack for either of the pickups is mounted. The copper backing is earthed in order to shield the circuit. These electronics are connected to an output jack 88 on plate 40 by a shielded cable (not shown) which travels through the top of the guitar directly below the pickguard, and which is held into the top of the body with a rubber grommet 89.

From the top of plate 43 extend the two rods of the trapeze tailpiece 92, to which the ends of the strings are secured.

While one embodiment of this invention has been illustrated in the accompanying drawings and described hereinabove, it will be evident to those skilled in the art that changes and modifications may be made therein, without departing from the essence of this invention, as set forth in the appended claims.

What I claim is:

1. A guitar having a body portion and a neck extending from said body portion, the body portion comprising central core means and a top and bottom panel of resilient sheet material sandwiching the core means between them, the panels being substantially flat when unstressed, but being bowed around the central core means so that the side edges of the panels are juxtaposed, whereby the top panel is stressed so that it is rounded convex upwardly and the bottom panel is stressed so that it is rounded convex downwardly, the two panels defining a volume of lenticular cross-section having two ends, a lower bridge foot secured against the top panel and supporting a lower bridge, and strings stretched between the lower bridge and a position on the neck.

2. The guitar claimed in claim 1, in which the core means includes at least one elongated perforated member.

3. The guitar claimed in claim 1, in which the volume between the two panels is closed at one end and open at the other.

4. The guitar claimed in claim 3, in which the said other end is the end from which the neck extends.

5. The guitar claimed in claim 4, in which the said other end is configured to provide two openings each defining an acute angle with the neck.

6. The guitar claimed in claim 1, in which the lower bridge foot has two pedestal portions separated by a raised central portion, the pedestal portions bearing against the top panel at locations which lie outwardly of the said core means.

7. The guitar claimed in claim 2, in which there are two said elongated perforated members spaced apart by a gap, the neck being integral with a neck-rail lodged in the gap between the perforated members.

8. The guitar claimed in claim 5, in which one of the openings is displaced with respect to the other longitudinally of the neck, thereby to provide a longer resonant chamber in the body portion to one side of the core means and a shorter resonant chamber to the other side, the former being the bass side of the guitar, and the latter being the treble.

9. The guitar claimed in claim 1, in which the neck has a fingerboard which widens adjacent the body portion.

* * * * *